United States Patent [19]

Khallil

[11] Patent Number: 4,497,136

[45] Date of Patent: Feb. 5, 1985

[54] SELF-ADJUSTING WEATHER STRIP

[76] Inventor: George Khallil, P.O. Box 481, Kentville, Nova Scotia, Canada

[21] Appl. No.: 560,252

[22] Filed: Dec. 9, 1983

Related U.S. Application Data

[63] Continuation of Ser. No. 886,411, Mar. 14, 1978.

[30] Foreign Application Priority Data

Mar. 15, 1977 [CA] Canada ..... 224,043

[51] Int. Cl.[3] ..... E06B 7/16

[52] U.S. Cl. ..... 49/481

[58] Field of Search ..... 49/481, 480

[56] References Cited

U.S. PATENT DOCUMENTS 2,694,239 11/1954 Brunker ..... 49/481
2,769,215 11/1956 Neff ..... 49/481
3,139,652 7/1964 Michaels ..... 49/481

FOREIGN PATENT DOCUMENTS 633872 2/1962 Italy ..... 49/480

*Primary Examiner*—Kenneth Downey
*Attorney, Agent, or Firm*—Murray Schaffer

[57] ABSTRACT

A self-adjusting weather strip comprised of: a main aluminum extrusion having a flat elongate base plate with an integral channel therealong, said channel being rectangular in cross section and having an elongate opening along one side thereof; a second elongate aluminum extrusion configured generally as an I beam in cross section, one cross bar of the I being approximately square in cross section and being adapted to be slidably received in the channel of said main extrusion with the stem of the I passing through said elongate opening thereof, the other cross bar of said I having means to retain an elongate weather strip facing member; and a plurality of curved bar springs within said channel between the side thereof opposite said elongate opening and the square of said I.

1 Claim, 9 Drawing Figures

SELF-ADJUSTING WEATHER STRIP

This is a continuation of U.S. Ser. No. 886,411, filed: Mar. 14, 1978.

This invention relates to a self-adjusting weather strip, the principal components of which are a pair of cooperating aluminum extrusions.

Many attempts have been made to provide a weather strip which is effective in sealing a door or the like, and the present invention is an improvement over all known prior art inasmuch as a secure seal is achieved, even when the strip is employed with a door having a slight warp which would be sufficient to make most or all other weather strips ineffective.

The invention disclosed herein provides a weather strip which is self-adjusting, with the novelty residing in a pair of aluminum extrusions, one extrusion having a channel, with an elongate opening along one side, the channel being adapted to receive a portion of the second extrusion, which projects through the opening, with spring means within the channel normally during the second extrusion toward one side thereof, as will become clear hereinafter. The weather stripping disclosed herein is effective in sealing a door or the like even though that door has a considerable warp. Further, the spring action provided by the subject weather strip effectively creates a maximum seal between the weather strip and the door or the like to which it is applied such seal being greatly enhanced by the novel spring means provided.

It is therefore a principal object of this invention to provide a self-adjusting weather strip comprised of a main aluminum extrusion having a flat elongate base plate with an integral channel therealong, said channel being rectangular in cross section and having an elongate opening along one side thereof; a second elongate aluminum extrusion configured generally as an I beam in cross section, one cross bar of the I being approximately square in cross section and being adapted to be slidably received in the channel of said main extrusion with the stem of the I passing through said elongate opening thereof, the other cross bar of said I having means to retain an elongate weather strip facing member; and a plurality of curved bar springs within said channel between the side thereof opposite said elongate opening and the square bar of said I.

This and other objects of the invention will become apparent in the light of the following description.

Reference will now be made to the accompanying drawings in which.

Figures 1, 2, 3, 4, 5, 6, 7:
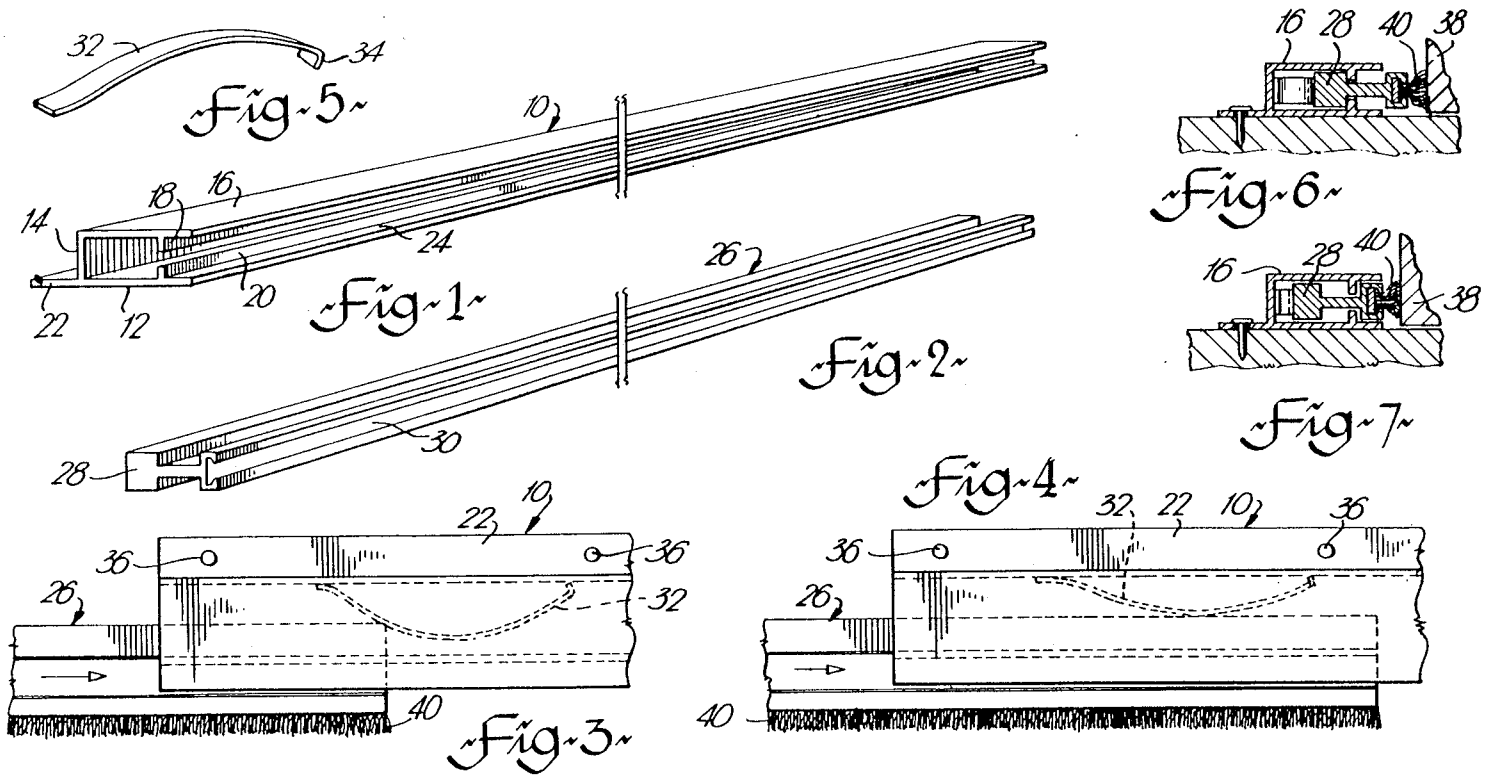
FIG. 1 is a perspective view of a main extrusion.
FIG. 2 is a perspective view of a second extrusion.
FIG. 3 is a partial plan view of the extrusions of FIGS. 1 and 2 in partially engaged relationship.
FIG. 4 is a view similar to that of FIG. 3 with the extrusions in further partial engagement.
FIG. 5 is a perspective view of a self-locking bar spring employed in the weather strip.
Figure 8:
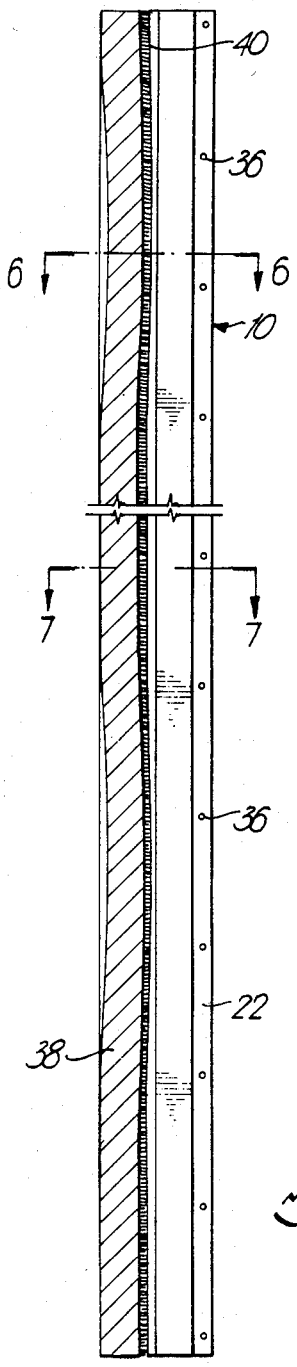
Figure 9:
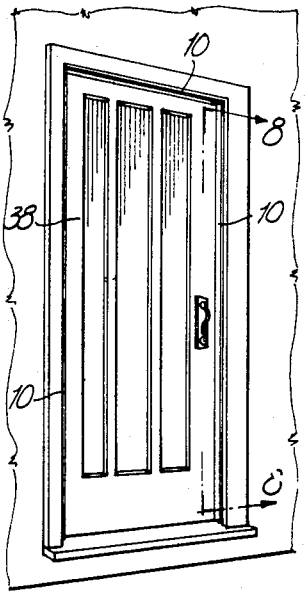

FIGS. 6 and 7 are sectional views taken along lines 6—6 and 7—7, respectively, of FIG. 8;

FIG. 8 is a side elevation partly in section of a weather strip according to the invention installed abutting a door, and is taken along line 8—8 of FIG. 9; and FIG. 9 is a plan view of a door having weather strip installed thereagainst.

Detailed reference will now be made to the drawings wherein like reference numerals will identify like parts.

As seen in FIGS. 1 and 2 an elongate aluminum extrusion indicated generally at 10 has a base plate 12 with a central channel of rectangular cross section formed thereon by rear wall 14, top wall 16 and a pair of lips 18 and 20, parallel with rear wall 14, lip 18 depending downwardly from top wall 16, lip 20 projecting upwardly from base plate 12, creating an elongate groove therebetween, in open communication with the interior of the rectangular channel thus formed. Base plate 12 extends outwardly beyond wall 14 and 22, to provide a mounting plate for the weather strip as will become clear hereinafter. Base plate 12 correspondingly projects outwardly beyond lip 20 at 24, as top wall 16 correspondingly projects outwardly an equal amount.

Illustrated in FIG. 1 is a "piston" extrusion indicated generally by reference numeral 26 having the general configuration of an I beam, with one cross bar 28 of the beam having a square cross section, the other cross bar having an elongate groove 30 running the length thereof.

As seen in FIGS. 3 and 4 the channel of aluminum extrusion 10 is adapted to receive a plurality of springs 32 illustrated in perspective in FIG. 5, and in broken lines in FIGS. 3 and 4, and as well slidably to receive bar 28 of extrusion 26. As seen most clearly in FIG. 5 spring 32 has a curved bar configuration, and at one end an integral, short, extension 34, projecting therefrom. Spring 32 is constructed of spring steel, and projection 24 will tend to bite rear wall 14 of extrusion 10, when placed thereagainst as shown in FIGS. 3 and 4. Thus, bar 28 of extrusion 26 is slidably urged into engagement in extrusion 10, spring 32 having been positioned therein will remain in the predetermined position selected, as bar 28 of extrusion 26 passes thereagainst, slightly compressing spring 32 against wall 14 of extrusion 10, with spring 32 remaining in the pre-selected position within the channel of extrusion 10. As seen in FIG. 4, for example, spring 32 has remained in its initial position, as extrusion 26 slides further into extrusion 10.

As seen in FIGS. 3, 4 and 8, screw holes 36 are provided along the length of plate 22, appropriately spaced.

Referring now to FIGS. 6, 7 and 8, the weather strip according to the invention is illustrated in mounted position along the edge of a door 38. It will be seen that a pile weather strip 40, such as the poly-pile weather stripping manufactured and sold by Schlegal, Oakville, Ontario, is slidably engaged within groove 30 of extrusion 26, for sealing engagement with door 38. In mounting the self-adjusting weather stripping according to the invention, door 38 is pulled closed, and the weather stripping is held on the side of the door frame, on the side opposite to which the door opens. The assembled weather strip is pressed firmly against the door, when the door has been firmly latched, to the extent that the pile weather stripping 40 urges the extrusion "piston" 26 inwardly within extrusion 10, against the resistance of spring 32, so that a firm contact is created between pile 40 and door 38. With the weather stripping so held in place, manually, marks are made through each of screw holes 36. The door may then be opened, and the weather strip assembly affixed to the door frame readily. Suitable caulking compound may be applied to the face of base 12 of the weather strip assembly before mounting. A shorter piece of self-adjusting weather strip according to the invention is also employed along the top of the door, and, if necessary, along the hinge edge of the door. Alternatively, however, weather stripping without the spring action of the subject weather strip may be employed along the hinge edge of a door being weather stripped.

With particular reference to FIGS. 6 and 7 it will be seen that when door 38 is fully closed pile weather strip 40 is pressed firmly against the inner edge of the door. Comparing FIG. 6 with FIG. 7 (and noting the corresponding section lines in FIG. 8) it will be seen that even though door 38 is slightly warped so that it is slightly further away from the pile 40, at the point indicated by section line 7—7 than it is at the point indicated by section line 6—6, the action of springs 32 against I beam extrusion 26 urges the forward edge of I beam 26, and thus weather pile 40 into close engagement with door 38, to achieve an effective weather seal.

It has been found that the provision of only three springs 32 is all that is required for a door of average height, that is, approximately seven feet, with one spring near each end, and a third spring near the center. The action of springs 32, and the slight pliability of aluminum extrusion 26 cooperate to achieve a complete and effective seal as described.

The foregoing is by way of example only, and the invention should be limited only by the scope of the appended claims.

I claim:

1. A self-adjusting weather strip assembly comprising a main aluminum extrusion having a flat elongate base plate with an integral channel therealong, said channel being rectangular in cross section having a first side wall and a second side wall, said first side wall having a smooth and uninterrupted surface, said second wall having an elongate opening therealong; a second elongate aluminum extrusion configured generally as an I beam in cross section, one cross bar of the I beam being approximately square in cross section and being adapted to be slidably received in the channel of said main extrusion with the stem of the I beam passing through said elongate opening thereof, the other cross bar of said I beam having an elongated slot an elongate weather strip facing member comprising an elongate pile strip and rigid backing said backing being slidable and retained in said slot with said pile extending outwardly therefrom; a plurality of curved bar springs slidable within channel between the first side wall and the square bar of said I beam and movable from one end to the other, each of said spring means having an integral short extension projecting from one end thereof and a curvature to press said square bar against said second side wall, said integral extension biting the surface of said first wall to maintain said spring means and said main and second elongate extrusions in relatively stationary selected positions when so pressed and freely movable relative to each other upon removal of said second elongate extrusion from said first extrusion.

* * * * *